United States Patent [19]

Ditzig

[11] 4,344,224

[45] Aug. 17, 1982

[54] METHOD OF MAKING HERMETICALLY SEALED SWITCH ASSEMBLY

[75] Inventor: Albert F. Ditzig, Hoffman Estates, Ill.

[73] Assignee: Molex Incorporated, Lisle, Ill.

[21] Appl. No.: 207,224

[22] Filed: Nov. 17, 1980

Related U.S. Application Data

[62] Division of Ser. No. 6,566, Jan. 26, 1979, Pat. No. 4,302,637.

[51] Int. Cl.[3] ..... H01H 11/00

[52] U.S. Cl. ..... 29/622; 29/884

[58] Field of Search ..... 29/613, 884, 622; 200/6 C, 6 B, 6 R, 6 BB, 16 R, 153 L, 153 LA, 300, 302, 303, 291, 5 R

[56] References Cited

U.S. PATENT DOCUMENTS

| | | | |
|---|---|---|---|
| 3,047,682 | 7/1958 | Hults | 200/153 LA |
| 3,657,492 | 4/1972 | Arndt et al. | 200/5 R |
| 3,676,625 | 7/1972 | Blott | 200/153 LA |
| 3,849,610 | 11/1974 | Lockand et al. | 200/6 BB |

*Primary Examiner*—Leon Gilden

*Attorney, Agent, or Firm*—Louis A. Hecht

[57] ABSTRACT

A switch assembly including a base member having a contact receiving cavity open at the top and defined by a floor that is laterally enclosed by side wall means, first terminal means in the cavity adapted for electrically connection to outside circuitry, second terminal means in the cavity adapted for electrical connection to outside circuitry having a resilient contact blade portion with an end above the first terminal means. The contact blade portion is moveable between a normally open position wherein the end is spaced from the first terminal means in a closed position wherein the end contacts the first terminal means. A thin, stretchable, resilient, impermeable sealing gasket is provided on the base member which overlies the cavity. A cover engages the periphery of the gasket and includes interengaging means cooperating with the base member to lock the covering gasket to the base member to form a hermetic seal over the cavity. An actuator assembly is mounted in association with the cover and includes an engaging portion mounted for general up and down movement against the gasket. The actuator assembly is moveable between an off position when engaging portion is in an up position and said contact blade portion is in the open position and an on position wherein the engaging portion is moved against the resilient force of the gasket to push the contact blade portion to the closed position.

7 Claims, 7 Drawing Figures

METHOD OF MAKING HERMETICALLY SEALED SWITCH ASSEMBLY

This application is a division of application Ser. No. 006,566, filed Jan. 26, 1979, now U.S. Pat. No. 4,302,637.

BACKGROUND OF THE INVENTION

1. Field of the Invention

The present invention relates to electrical switches and, more particularly, to electrical switches of the type having a contact receiving cavity that is hermetically sealed.

2. Brief Description of the Prior Art

It is found to be desireable to completely seal off the contacts of small switches such as subminiature switches from atmosphere contaminants such as moisture and dust. This is necessary because contaminants can enter the switch housing from around the switch terminals, through openings in the switch housing or from any of the interfaces of the various switch housing components. This may occur during a wave soldering operation. Any contaminant which enters the contact blade assembly of a switch may cause the switch to fail due to corrosion and other modes of failure.

One type of switch where sealing is found to be successful is in keyboard switches. Examples of arrangements which provide effective sealing for keyboard switches are disclosed in the following Patents:

U.S. Pat. No. 3,657,492 issuing Apr. 18, 1972
U.S. Pat. No. 3,749,859 issuing July 31, 1973
U.S. Pat. No. 3,829,632 issuing Aug. 13, 1974
U.S. Pat. No. 3,978,297 issuing Aug. 31, 1976
U.S. Pat. No. 3,996,428 issuing Dec. 7, 1976
U.S. Pat. No. 4,018,999 issuing Apr. 19, 1977

As the above patents disclose, it is easy to effect a hermetic seal by providing a mylar or other type of plastic-type sheet in a substrate which comprises the switch assembly. The sealing is found to be relatively simple in that the entire switch assembly is basically flat. This means that all components of the assembly comprising the substrate are in parallel adjacent planes. It is, therefore, not difficult to provide an adhesive or heat sealing process to the sealing sheet to provide the required hermetic seal.

The problem is considerably different when dealing with a switch assembly having a base member with a contact receiving cavity which is open at the top and defined by a floor that is laterally closed by side wall means. Switch assemblies of this kind usually have a first terminal means in the cavity adapted for electrical connection to outside circuitry and a second terminal means in the cavity adapted for electrical connection to outside circuitry having a resilient contact blade portion with an end spaced from the first terminal means. The contact blade portion is moveable between a normally open position wherein the end is spaced from the first terminal means and a closed position wherein the end contacts the first terminal means. A cover is provided to be mounted over the base member and has means for mounting an actuator assembly thereon. An actuator assembly is mounted in association with the mounting means of the cover to turn the switch between its on and off states.

The main concern with the structure of the type defined is to prevent contaminants from entering the interface between the cover and the base member and/or the mounting means where the actuator assembly is mounted. Seal arrangements have been provided in switch assemblies of the type described to prevent contaminants from entering the area where the actuator assembly is mounted. Examples of this type of seal are disclosed in U.S. Pat. No. 3,558,423 issuing June 1, 1971 and U.S. Pat. No. 3,789,176 issuing Jan. 29, 1974. Even though these arrangements effectively seal the area where the actuator assembly is mounted, a secondary operation must be provided to seal the interface between the cover and the base member. For example, in U.S. Pat. No. 3,558,423 the mating surfaces between the cover and base member are sealed by means of an epoxy resin.

Another problem which is prevelant with subminiature switches is to provide an actuator assembly arrangement that can be easily assembled. It can be appreciated that extremely small components must be used which are not easily handled in any assembly-type operation.

SUMMARY OF THE INVENTION

It is, therefore, the principal object of the present invention to provide an improved switch assembly of the type which includes a base member having a contact receiving cavity open at the top and defined by a floor that is laterally enclosed by side wall means, a first terminal means in the cavity adapted for electrical connection to outside circuitry, second terminal means in the cavity adapted for electrical connection to outside circuitry having a resilient contact blade portion with an end spaced from said first terminal means, said contact blade portion being moveable between a normally open position wherein said end is spaced from said first terminal means and a closed position wherein said end contacts said first terminal means, a cover mounted on said base member having means for mounting an actuator assembly thereon, and a actuator assembly mounted on the mounting means of the cover actuable for moving said contact blade portion to its closed position.

More particularly, it is the principal object of the present invention to provide an improved switch assembly of the type defined which hermetically seals the contact receiving cavity at all the interfaces between the base member and cover which is easy to assemble.

One improvement which accomplishes the stated objects comprises:

a thin, stretchable, resilient, impermeable sealing gasket on said base member which overlies said cavity; said cover engaging the periphery of said gasket and including interengaging means cooperating with said base member to lock said cover and gasket to said base member to form a hermetic seal over said cavity; and said actuator assembly including a push member mounted for general up and down movement against the gasket, said actuator assembly being moveable between an off position wherein the push member is in an up position and said contact blade portion is in the open position and an on position wherein the push member is moved against the resilient force of the gasket to push the contact blade portion to the closed position.

Another improvement which accomplishes the stated objects comprises:

A method of making a switch assembly including forming a base member with a contact receiving cavity open at the top and defined by a floor that is laterally enclosed by side wall means, forming first terminal means and mounting said first terminal means in the cavity, forming second terminal means with a resilient contact blade portion and mounting said second terminal means in the cavity so that an end of the blade portion is spaced from said first terminal means, said contact blade portion being movable between a normally open position wherein said end is spaced from said first terminal means and a closed position wherein said end contacts said first terminal means, forming a cover with means for mounting an actuator assembly thereon, and forming an actuator assembly including a push member mounted on the mounting means of the cover for moving the contact blade portion between its open and closed positions, the improvement in said method comprising:

providing a thin, stretchable, resilient, impermeable sealing gasket;

placing said sealing gasket on top of the base member so that it overlies said cavity;

forming said cover and said base member to include interengaging means to lock said cover to said base member;

placing said cover over the base member so that it engages the periphery of said sealing gasket;

locking said cover and gasket to said base member by means of said interengaging means to form a hermetic seal over said cavity; and mounting said push member in a manner so that it engages the gasket and is movable against the resilient force thereof to push the contact blade portion between its open and closed positions.

Another improvement which accomplishes the stated objects comprises:

A method of making the switch assembly including forming a base member with a contact receiving cavity open at the top, forming first terminal means and mounting said first terminal means in the cavity, forming second terminal means with a resilient contact blade portion and mounting said second terminal means in the cavity so that an end of the blade portion is spaced from said first terminal means, said contact blade portion being movable between a normally open position wherein said end is spaced from said first terminal means and a closed position wherein said end contacts said first terminal means, forming actuator assembly mounting means, a manually manipulatable portion and said push member to said mounting means to form an actuator assembly, the improvement in said method comprising:

forming said push member integrally with said mounting means with frangible portions formed therebetween;

mounting said integral push member and mounting means on said base member over said contact receiving cavity;

breaking said push member away from said mounting means so that it is associated with said contact blade portion; and mounting said manually manipulatable portion on the mounting means in association with said push, member.

DESCRIPTION OF THE PREFERRED EMBODIMENT

Figure 1:
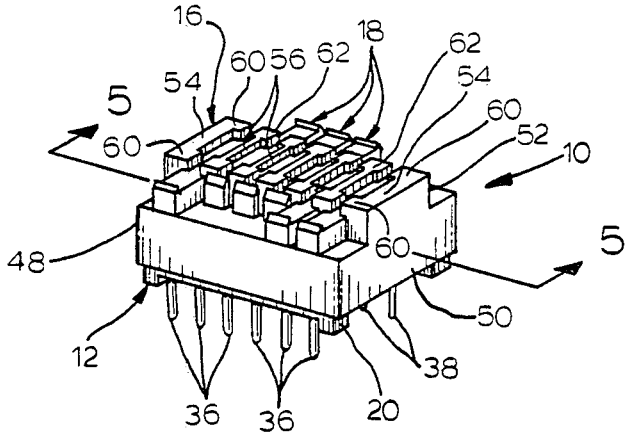
FIG. 1 is a perspective view of the switch assembly of the present invention.
Figure 3:
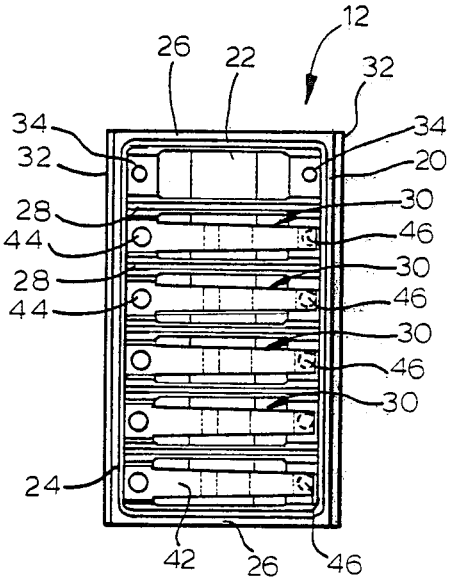
FIG. 3 is a top plan view of the base assembly of the switch assembly of the present invention.
Figure 2:
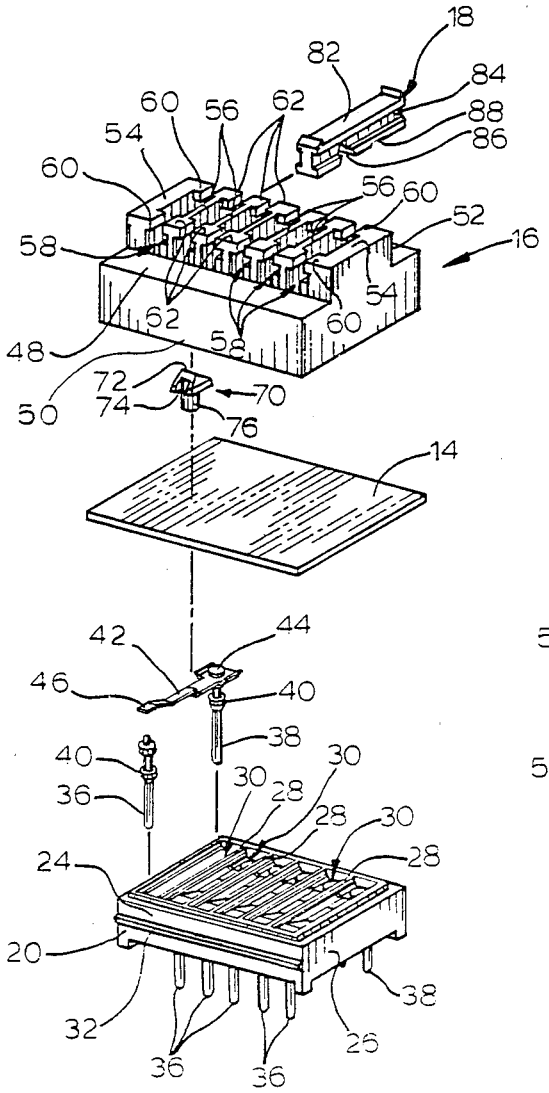
FIG. 2 is an exploded perspective view of the switch assembly of the present invention.

Turning now to FIGS. 1 and 2, the switch assembly of the present invention, generally designated 10, is shown in greater detail. The switch assembly 10 is seen to generally include a base assembly, generally designated 12, a gasket seal 14 adapted to overlie the base assembly 12, a cover assembly, generally designated 16, which is adapted to overlie the gasket seal and base assembly, and a manually manipulatable portion 18 of an actuator assembly which is adapted to be mounted to the cover assembly 16. (With the gasket 14 therebetween.)

The base assembly 12 includes a base member 20 which is defined by a floor 22 which is laterally enclosed by two pair of opposing parallel side walls 24 and 26, respectively. A plurality of interior spaced apart walls 28 are provided which are parallel with side walls 26. The side walls 26 in conjunction with the interior walls 28 define a plurality of contact receiving cavities, generally designated 30. Side walls 24 and 26 each have welding bead 32 formed thereon for purposes which will become more apparent hereinafter.

Each cavity 30 has a pair of holes 34 formed in the floor 22. Holes 34 are adapted to receive in a press fit fashion two pins 36 and 38 each having a conical lock surface 40 formed thereon to anchor the pins in the floor 22. The arrangement ensures that no contaminants will enter the contact receiving cavities 30 through the holes 34.

A contact blade 42 provides the electrical connection between pins 36 and 38. More specifically, at one end of contact blade 42 there is provided a cap 44 which is adapted to be staked or welded on top of pin 38. The other end 46 of contact blade 42 is adapted to overlie the top if pin 36 so that it is normally spaced thereabove. The contact blade 42 is made of relatively thin resilient conductive material and, when assembled, is moveable between a normally "open" position wherein end 46 is above pin 36 and a "closed" position wherein contact blade 42 is moved downwardly so that end 46 contacts the top of pin 36. The other ends of pins 36 and 38 which extend below the floor 22 are adapted to be electrically connected to other circuitry (not shown).

The cover assembly 16 is seen to include a lower portion 48 having a depending lip 50 around the periphery thereof and an upper castle portion 52. The castle portion 52 has two end walls 54 and a plurality of interior parallel spaced apart walls 56 between the end walls 54. The spaces between the end walls 54 and interior walls 56 define actuator receiving recesses, generally designated 58, therebetween, one above each contact receiving cavity 30. Projections 60 and 62 are provided on top of the end walls 54 and interior walls 56, respectively, to capture a portion of an actuator assembly in the castle portion 52.

Figure 4:
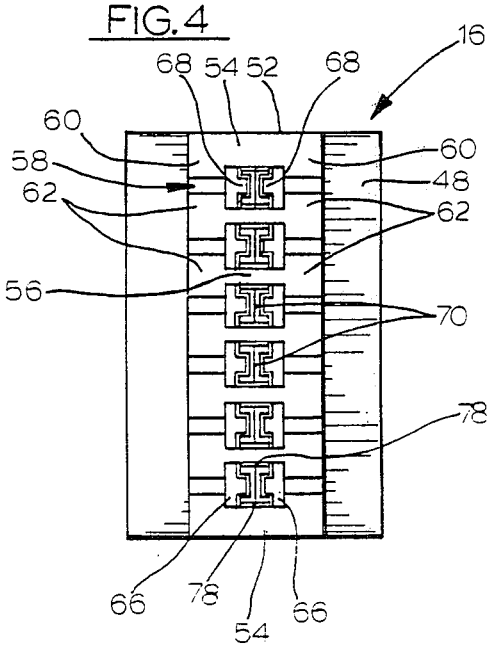
FIG. 4 is a top plan view of the cover assembly of the switch assembly of the present invention.

Looking at FIG. 4, each actuator receiving recess 58 has a pair of spaced apart rails extending between the adjacent interior walls 56 (or end wall 54). Formed in the middle of each of the rails 66 is a guide protrusion 68 whose purposes will become more apparent hereinafter.

A push member, generally designated 70, is provided in each actuator receiving recess 58 and is integrally molded with the cover assembly 16. Each push member 70 has an arrow-like guide portion 72 with a pair of cut outs 74 and a depending cylindrical shaft portion 76. The push member 70 is formed with the cover assembly 16 through a frangible connection 78 on the interior surfaces of the interior walls 56 and/or end walls 54.

In assembly, the pins 36 and 38 are press fit into their respective holes 34. The contact blade 42 is then mounted and connected to the top of pin 38 in the manner heretofore described. After all of the cavities 30 have been assembled, the gasket seal 14 is placed over the base assembly 12 so that it completely overlies all of the cavities 30 with the periphery of the gasket seal 14 overhanging the outside edges of the side walls 24 and 26. The gasket 14 is made of thin, stretchable, resilient impermeable material such as a rubber or neoprene sheet.

The cover assembly 16 is then fit over the gasket seal 14 and base assembly 12. The lip 50 of the cover assembly 16 initially engages the lower portion 48 closely fits and squeezes the seal 14 against side walls 24 and 26 while the depending lip 50 is adjacent the welding bead 32. An ultrasonic operation well-known in the art welds the lip 50 against the ridge 32 to the side wall 24. This holds the cover assembly 16 to the base member 20 and hermetically seals the contact receiving cavities 30 from above.

Figure 5:
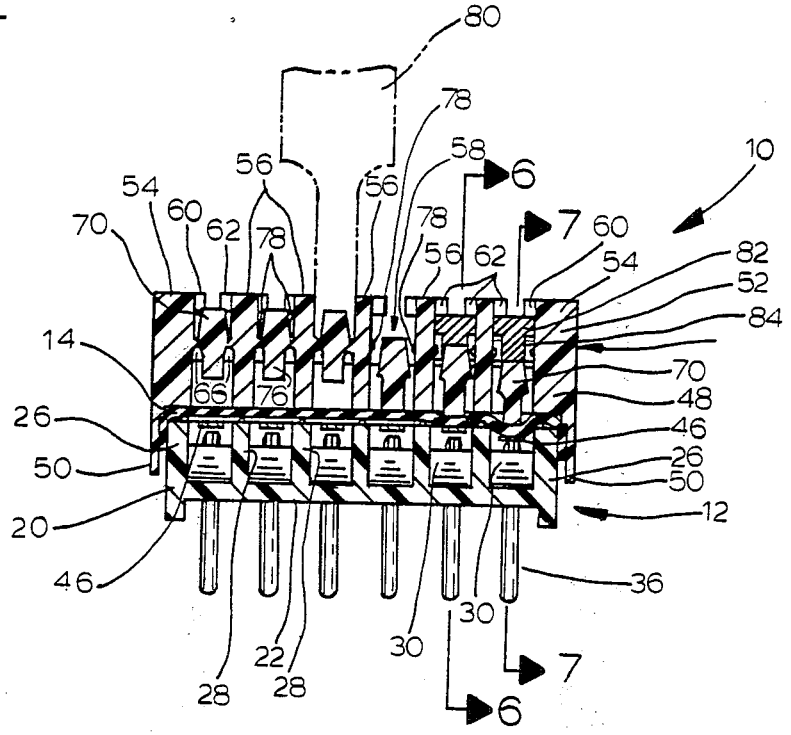
FIG. 5 is a side sectional view of the switch assembly of the present invention which has been partially assembled.

It is necessary to break the push member 70 from their respective actuator receiving recesses 58. To this end a small tool 80 is shown in phantom in FIG. 5 is provided to apply a downward force. When each push member 70 is broken loose, it falls freely so that the bottom of the shaft portion 76 rests on top of the gasket seal 14 while the guide protrusions 68 are received into the cut outs 74 of the arrow-like guide portion 72. This fully aligns the push member 70 for up and down reciprocal movement within each respective actuator receiving recess 58. The respective push members 70 cannot fall out of the top of the cover assembly 16 due to the remaining material left of the frangible connection 78.

Each push member 70 which comprises a part of an actuator assembly is caused to move downwardly by virtue of movement of the manually manipulatable actuator portion 18. This actuator portion 18 is shown to be a slide-type actuator although it is understood that any type of actuator could be used to produce the necessary downward force on the push member 70.

The manually manipulatable actuator portion 18 is seen to have a pair of recesses 84 formed in the sides thereof which are adapted to receive the remainder of the frangible connections 78. Each such actuator portion 18 also has formed in the bottom surface thereof a cam ramp 86 and a very shallow notch 88.

Each actuator portion 18 is slid into its respective actuator receiving recess 58 until the arrow-like guide portion 72 is received in the cam ramp 86. It is to be noted that the resiliency of the gasket seal 14 allows a slight downward movement of the push member 70 to accomplish this.

Figure 6:
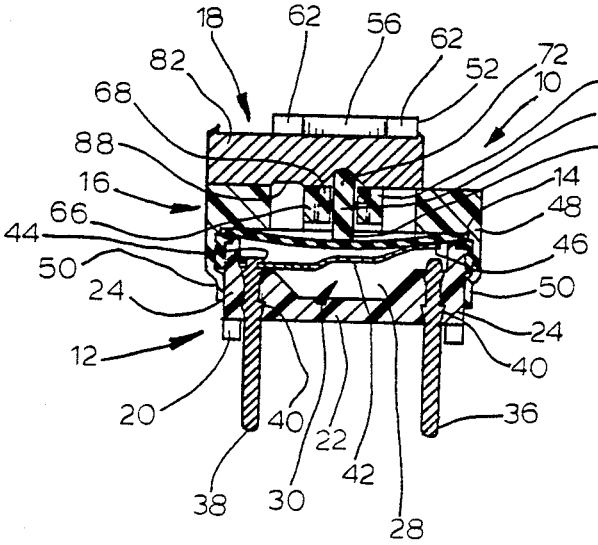
FIG. 6 is a sectional view taken generally along the lines 6—6 of FIG. 5.
Figure 7:
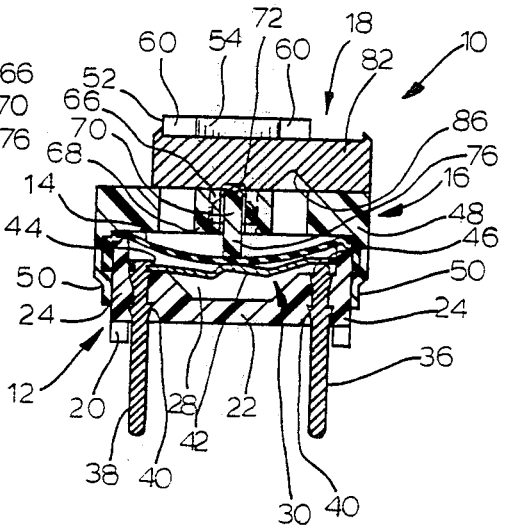
FIG. 7 is a sectional view taken generally along the lines 7—7 of FIG. 5.

After the actuator portion 18 is moved so the guide portion 72 is received in the cam ramp 86, the particular switch assumes an "off" position as is best shown in FIG. 6. When the actuator portion 18 is moved to the right, the interaction of the arrow-like guide portion 72 following the cam ramp 56 causes the push member 70 to move downwardly until the arrow-like guide portion 72 seats in the notch 88 at the bottom of the actuator portion 18. This defines the "on" position wherein the shaft portion 76 of the push member 70 pushes downwardly against the resilient force of the gasket seal 14 which, in turn, engages the contact blade 42 so that the end 46 thereof contacts pin 38 which defines the "closed" position.

It is to be recognized that any type of contact configuration can be used in the base assembly 12. Likewise, as was already pointed out, any type of actuator motion can be employed.

The switch assembly 10 as described hermetically seals the interior of each contact receiving cavity 30 from outside contaminants. This seal is not only effective around the actuator area but also in the interface of the lip 50 of the cover assembly 16 and the side walls 26 and 28 of the base assembly 12. No secondary operation such as epoxy resin sealing is necessary.

It is also to be noted that by integralling molding a portion of the actuator assembly, i.e., the push member 70, with the cover assembly 16, one of the most undesirable aspects of the assembly of a switch of this nature is avoided. To attempt to hand assemble a small push member 70 of the type described in each respective actuator receiving recess, is an extremely difficult task.

I claim:

1. A method of making a switch assembly including forming a base member with a contact receiving cavity open at the top and defined by a floor that is laterally enclosed by side wall means, forming first terminal means and mounting said first terminal means in the cavity, forming second terminal means with a resilient contact blade portion and mounting said second terminal means in the cavity so that an end of the blade portion is spaced from said first terminal means, said contact blade portion being movable between a normally open position wherein said end contacts said first terminal means, forming a cover with means for mounting an actuator assembly thereon, and forming an actuator assembly including a push member mounted on the mounting means of the cover for moving the contact blade portion between its open and closed positions, the improvement in said method comprising:

providing a thin, stretchable, resilient, impermeable sealing gasket;

placing said sealing gasket on top of the base member so that it overlies said cavity;

forming said cover and said base member to include interengaging means to lock said cover to said base member;

placing said cover over the base member so that it engages the periphery of said sealing gasket;

locking said cover and gasket to said base member by means of said interengaging means to form a hermetic seal over said cavity; and mounting said push member in a manner so that it engages the gasket and is movable against the resilient force thereof to push the contact blade portion between its open and closed positions.

2. The method of claim 1 wherein the step of forming and mounting said first and second terminal means includes inserting said terminal means through the base member in a manner that prevents contaminants from outside the base member from entering the terminal receiving cavity.

3. The method of claim 2 wherein said inserting step includes press fitting said terminal means through said base member.

4. A method of making the switch assembly including forming a base member with a contact receiving cavity open at the top, forming first terminal means and mounting said first terminal means in the cavity, forming second terminal means with a resilient contact blade portion and mounting said second terminal means in the cavity so that an end of the blade portion is spaced from said first terminal means, said contact blade portion being movable between a normally open position wherein said end is spaced from said first terminal means and a closed position wherein said end contacts said first terminal means, forming actuator assembly mounting means, a manually manipulatable portion and a push member, and assembling said manually manipulatable portion and said push member to said mounting means to form an actuator assembly, the improvement in said method comprising:

forming said push member integrally with said mounting means with frangible portions formed therebetween;

mounting said integral push member and mounting means on said base member over said contact receiving cavity;

breaking said push member away from said mounting means so that it is associated with said contact blade portion; and mounting said manually manipulatable portion on the mounting means in association with said push member.

5. The method of claim 4 including forming a cover which includes said actuator assembly mounting means, forming said cover and said base member with interengaging means to lock said cover onto said base member.

6. The method of claim 5 including providing a thin, stretchable, resilient, impermeable sealing gasket, placing said sealing gasket on said base member so that it overlies said contact receiving cavity, and locking said cover and gasket to said base member by means of said interengaging means to form a hermetic seal over said cavity.

7. The method of claim 5 wherein said cover forming step includes the step of forming means to capture the push member in the actuator mounting means.

* * * * *